US007031625B2

(12) United States Patent
Ebe

(10) Patent No.: US 7,031,625 B2
(45) Date of Patent: Apr. 18, 2006

(54) IMAGE FORMING APPARATUS

(75) Inventor: Takaaki Ebe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 119 days.

(21) Appl. No.: 10/853,308

(22) Filed: May 25, 2004

(65) Prior Publication Data

US 2004/0240899 A1 Dec. 2, 2004

(30) Foreign Application Priority Data

May 28, 2003 (JP) ..... 2003-151187

(51) Int. Cl.
*G03G 15/00* (2006.01)

(52) U.S. Cl. ..... 399/44; 399/50; 399/51; 399/53

(58) Field of Classification Search ..... 399/38, 399/43, 44, 47, 49, 50, 51, 53, 55
See application file for complete search history.

(56) References Cited

U.S. PATENT DOCUMENTS 6,434,344 B1 * 8/2002 Yoshida et al. ..... 399/44
6,553,191 B1 * 4/2003 Nakane ..... 399/38
6,564,022 B1 * 5/2003 Tamura et al. ..... 399/49
6,584,292 B1 * 6/2003 Sasai ..... 399/44

FOREIGN PATENT DOCUMENTS

JP 11-184190 A 7/1990

* cited by examiner

*Primary Examiner*—Hoan Tran
(74) *Attorney, Agent, or Firm*—Akin Gump Strauss Hauer & Feld, LLP

(57) ABSTRACT

An image forming section includes an image bearing body that bears an electrostatic latent. An operation status detecting section detects at least one of an operation status in which the image forming section operates and an environmental condition in which the image forming section operates. The operation status includes, for example, the number of printed pages, the density of toner image, and the amount of toner consumed. A print condition setting section sets preliminary print conditions. The preliminary print condition includes a developing voltage, the amount of light emitted from an exposing unit, and a charging voltage. A limit setting section sets a limit value based on the environmental conditions. A print controller compares the preliminary print condition with the limit value to determine an ultimate print condition so that the ultimate print condition is within a predetermined range.

20 Claims, 10 Drawing Sheets

TABLE 1

| MEMBER OF PRINTED PAGES | 0~1K | 1K~10K | 10K~ |
|---|---|---|---|
| DBL | −195V | −175V | −145V |

FIG.7

TABLE 2

| | LOW TEMPERATURE | | MID TEMPERATURE | | HIGH TEMPERATURE |
|---|---|---|---|---|---|
| TEMPERATURE RANGE | 1 | 2 | 3 | 4 | 5 |
| TEMPERATURE (℃) | ≦10 | 11—20 | 21—30 | 31—41 | 40≦ |

TABLE 3

| | LOW TEMPERATURE | | MID TEMPERATURE | | HIGH TEMPERATURE |
|---|---|---|---|---|---|
| HUMIDITY RANGE | 1 | 2 | 3 | 4 | 5 |
| ABSOLUTE HUMIDITY (g/m3) | ≦4 | 5—8 | 9—12 | 13—16 | 17≦ |

TABLE 4

| | | | | | |
|---|---|---|---|---|---|
| ENVIRONMENT RANGE | 1—5 | 6—10 | 11—15 | 16—20 | 21—25 |
| CORRECTION VOLTAGE Dh (V) | 30 | 15 | 0 | —15 | —30 |

TABLE 5

| COLOR | YELLOW | MAGENTA | CYAN | BLACK |
|---|---|---|---|---|
| CORRECTION VOLTAGE Dh' (V) | 30 | −30 | 15 | 30 |

IMAGE FORMING APPARATUS

BACKGROUND OF THE INVENTION

1. Field of the Invention

The present invention relates to an electrophotographic image-forming apparatus.

2. Description of the Related Art

A conventional electrophotographic image-forming apparatus performs an electrophotographic process. A charging unit (e.g., charging roller) charges the surface of an image bearing body (e.g., photoconductive drum). Then, a developing section (e.g., developing roller) applies a thin layer of toner to the electrostatic latent image electrostatically, thereby developing the electrostatic latent image into a toner image. A transfer section transfers the toner image onto a print medium. A cleaning section removes residual toner that failed to be transferred to the print medium.

One such conventional image-forming apparatus is disclosed in Japanese Patent Laid Open No. 11-184190. This image-forming apparatus performs correction of toner density of printed images in addition to the aforementioned electrophotographic image formation. The correction of toner density of printed images is to maintain the toner density that would otherwise change over time or due to changes in environmental conditions. In the correction of toner density, a test pattern is formed on an image bearing body or an intermediate transfer belt. A toner density detecting section detects the toner density of the test pattern. The toner density varies in accordance with various print conditions such as the amount of light emitted from an exposing unit, a developing voltage applied to a developing roller, and a toner supplying voltage applied to a toner-supplying roller. Thus, these print conditions are controlled based on the toner density detected by the toner density detecting section.

For example, the ability of toner to acquire charge varies due to changes in environmental conditions. A developing blade and the toner-supplying roller wear over time so that the density of toner increases due to increases in the thickness of toner layer. In order to prevent the toner density from increasing, the developing voltage, for example, is decreased below a predetermined level to decrease the toner density. Too low a developing voltage causes graininess (i.e., reproducibility of dots) to deteriorate. Thus, it is necessary not to decrease the developing voltage below a certain lower limit.

When the toner density decreases, the developing voltage is controlled in such a way that the toner density increases. Conversely, too high a developing voltage causes soiling of images or gives rise to "after-images". Thus, it is necessary no to increase the developing voltage above a certain upper limit.

The aforementioned conventional image-forming apparatus suffers from the following drawbacks. The developing voltage is controlled within a range having a fixed upper limit and a fixed lower limit. Therefore, the graininess can deteriorate or soiling of images may occur depending on changes in the conditions of the apparatus over time and/or changes in environmental conditions.

SUMMARY OF THE INVENTION

An object of the present invention is to provide an image-forming apparatus in which image-forming conditions are always properly controlled not to cause graininess and soiling of images.

An image-forming apparatus includes an image forming section having an image bearing body that bears an electrostatic latent image. A status detecting section detects at least one of an operation status in which said image-forming section operates and an environmental condition on which said image forming section operates. A print condition setting section sets a preliminary print condition for said image forming section. A limit setting section sets a limit value in accordance with the at least one of the operation status and the environmental condition. A print controller compares the preliminary print condition with the limit value to determine an ultimate print condition for the image forming section based on a comparison result.

The image forming section includes a developing unit that supplies toner to the electrostatic latent image formed on the image bearing body to form a toner image.

The ultimate print condition is a voltage that should be supplied to the developing unit.

The preliminary print condition is a voltage that should be supplied to the developing unit.

The image-forming apparatus further includes a toner density detecting section. The print controller controls the toner density detecting section to detect a toner density of the toner image and then the print condition setting section sets, based on the toner density, the voltage that should be supplied to the developing unit.

The operation status may be a number of printed pages. The limit setting section sets the limit value based on the number of printed pages.

The preliminary print condition is a voltage that should be supplied to the developing unit, the limit value being a lower limit value of the voltage and increasing in absolute value with decreasing number of printed pages.

The limit value may be changed stepwise.

The limit value may be varied continuously.

The image-forming apparatus further includes a temperature detecting section that detects a temperature at which the image forming section operates and a humidity detecting section that detects a humidity at which the image forming section operates. The limit setting section determines the limit value based on the temperature and the humidity.

The operation status is a number of printed pages. The limit setting section determines the limit value based on the number of printed pages and then determines the limit value based on the temperature and humidity.

The limit value is determined such that the limit value has a larger absolute value in a high-temperature and high-humidity environment than in a low-temperature and low-humidity environment.

The preliminary print condition may be a voltage that should be supplied to the developing unit, the limit value being an upper limit value of the voltage.

The image-forming apparatus further includes a temperature detecting section that detects a temperature at which the image forming section operates. The limit setting section determines the limit value based on the temperature.

The image-forming apparatus further includes a humidity detecting section that detects a humidity at which the image forming section operates. The limit setting section determines the limit value based on the humidity.

The image forming section may be one of a plurality of image forming sections, and the limit setting section sets limit values so that the plurality of image forming sections operate on different ultimate print conditions.

The plurality of image forming sections include a yellow image forming section, a magenta image forming section, a cyan image forming section and a black image forming section.

The operation status is an amount of toner consumed, wherein the limit setting section determines the limit value based on the amount of toner consumed.

The image forming section includes a charging unit that charges a surface of the image bearing body, and the ultimate print condition is a voltage that should be applied to the charging unit.

The image forming section includes an exposing unit that illuminates a surface of the image bearing body to form an electrostatic latent image, and the ultimate print condition is an output of the exposing unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 7 shows TABLE 2 to TABLE 4 that illustrate environmental conditions in five levels;

DETAILED DESCRIPTION OF THE INVENTION

First Embodiment

{Construction}

Figure 1:
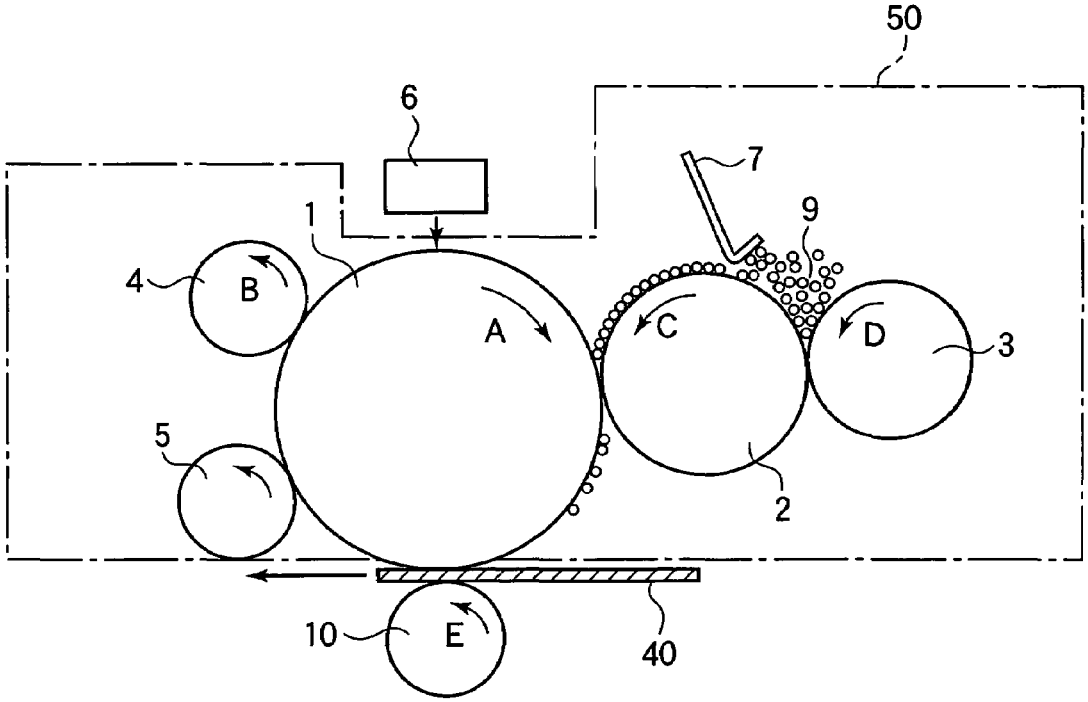
FIG. 1 illustrates the configuration of an image-forming apparatus according to a first embodiment.

Embodiments of the present invention will be described in detail with reference to the accompanying drawings. Like elements have been given like reference numerals throughout the drawings.

A first embodiment of the invention incorporates a limit determining means that adjusts upper and lower limits of a developing voltage DB during correction of toner density.

FIG. 1 illustrates the configuration of an image-forming apparatus according to the first embodiment.

Referring to FIG. 1, a photoconductive drum 1 includes an electrically conductive core (e.g., aluminum) covered with an organic photoconductive layer, and rotates in a direction shown by arrow A. A charging roller 4 rotates in contact with the photoconductive drum 1 in a direction shown by arrow B to charge the surface of the photoconductive drum 1 to a predetermined potential. An LED head 6 illuminates the charged surface of the photoconductive drum 1 in accordance with print data to form an electrostatic latent image. A developing roller 2 is formed of an electrically semiconductive rubber such as urethane. The developing roller 2 receives the developing voltage DB, and rotates in contact with the photoconductive drum 1 in a direction shown by arrow C, thereby applying toner 9 to the electrostatic latent image. A toner-supplying roller 3 rotates in a direction shown by arrow D. The toner-supplying roller 3 is formed of a foamed rubber material that improves the ability of the toner-supplying roller 3 to supply the toner 9 to the developing roller 2. A developing blade 7 is in pressure contact with the developing roller 2 to form a thin layer of toner 9 on the developing roller 2. A transfer roller 10 rotates in a direction shown by arrow E and transfers the toner image from the photoconductive drum 1 onto a print medium 40 by the Coulomb force. A cleaning roller 5 removes residual toner that remains on the photoconductive drum 1 after transfer. The charging roller 4 is formed of a semiconductive rubber material such as epichlorohydrin rubber and is in the shape of a roller formed on the metal shaft.

When the photoconductive drum 1 rotates in the A direction, the charging roller 4, developing roller 2, toner-supplying roller 3, and transfer roller 10 are rotated in directions shown by the respective arrows.

The cleaning roller 5, charging roller 4, developing roller 2, toner-supplying roller 3, developing blade 7 and photoconductive drum 1 are all housed in an ID cartridge 50. The ID cartridge 50 facilitates maintenance of the apparatus and replacement of a toner cartridge, not shown.

Figure 2:
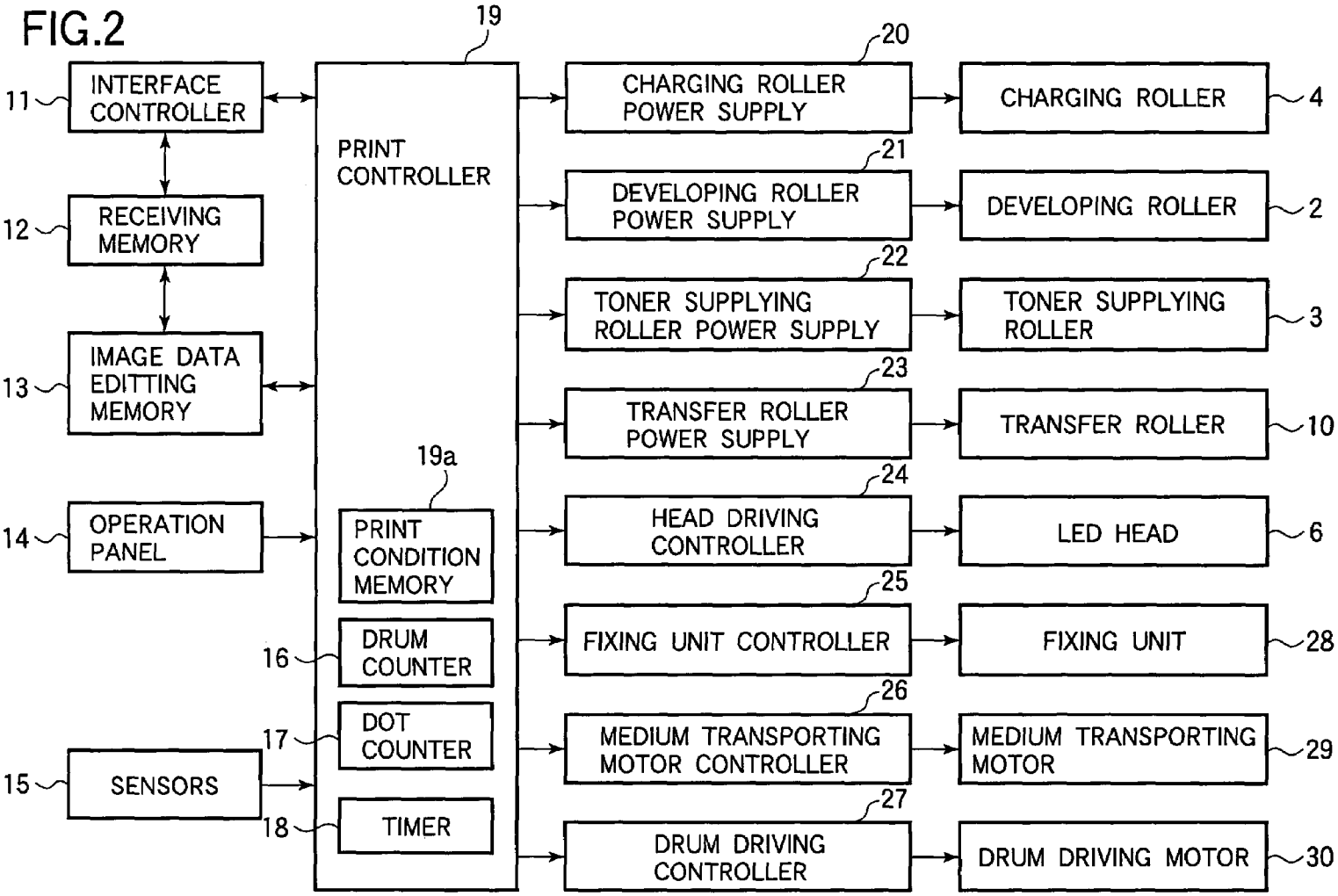
FIG. 2 is a control block diagram of the first embodiment.

FIG. 2 is a control block diagram of the first embodiment.

A print controller 19 includes a microprocessor, a ROM, a RAM, an I/O port, a print condition memory 19a, a drum counter 16, a dot counter 17, and a timer 18. The drum counter 16 holds a drum count Dp, i.e., a value that corresponds to the cumulative number of rotations of the photoconductive drum 1. An interface controller 11 is connected to the print controller 19 and receives print data and control commands from a host apparatus. The interface controller 11 controls the overall sequence of a printing operation performed by the image-forming apparatus. A receiving memory 12 temporarily stores the print data received through the interface controller 11 from the host apparatus. An image data editing memory 13 receives the print data from the receiving memory 12 and edits the print data to produce image data. An operation panel 14 includes, for example, an LCD that displays the status of the image-forming apparatus and a touch panel through which a user inputs various commands. Sensors 15 include various sensors such as paper position detecting sensors, a temperature sensor, a humidity sensor, and a toner density sensor. These sensors monitor the operational statuses of the image-forming apparatus and environmental conditions in which the image-forming apparatus operates.

The toner density sensor usually includes a light-emitting element and a light-receiving element for the purpose of detecting the toner density of the image of test pattern. The light-emitting element takes the form of, for example, an LED that emits light toward a test pattern. The light-receiving element takes the form of, for example, a photodiode that receives light reflected back from the image of the test pattern. The toner density sensor is located close to the photoconductive drum 1 or the transfer belt, and detects the density of the test pattern.

The print controller 19 is connected to a charging roller power supply 20, a developing roller power supply 21, a toner supplying roller power supply 22, and a transfer roller power supply 23, which operate under the control of the print controller 19. The charging roller power supply 20 supplies a voltage to the charging roller 4. The developing roller power supply 21 supplies a voltage to the developing roller 2. The toner supplying roller power supply 22 supplies a voltage to the toner-supplying roller 3. The transfer roller power supply 23 supplies a voltage to the transfer roller 10.

It is common that the print controller 19 controls the charging roller power supply 20, developing roller power supply 21, and toner-supplying roller power supply 22 independently of one another. The voltage of the toner-supplying roller power supply 22 may be divided by using, for example, resistors and/or a Zener diode, not shown, to provide the developing voltage DB to the developing roller 2, thereby eliminating the developing voltage power supply 21.

The print controller 19 is also connected to a head driving controller 24, a fixing unit controller 25, a medium transporting motor controller 26, and a drum driving controller 27. The head driving controller 24 transmits the image data from the image data editing memory 13 to the LED head 6, and, drives the LED head 6 to form an electrostatic latent image in accordance with the image data. The fixing unit controller 25 energizes the fixing unit 28 in such a way that the fixing unit 28 is heated to a predetermined fixing temperature in accordance with the output of the temperature sensor. The medium transporting motor controller 26 controls a medium transporting motor 29 to transport the print medium 40 in response to a command from the print controller 19. The drum driving controller 27 controls a drum driving motor 30 to drive the photoconductive drum 1 in rotation.

{Correction of Toner Density}

The image-forming apparatus according to the first embodiment operates as follows:

A normal printing operation is much the same as that of a conventional electrophotographic image-forming apparatus and therefore the description thereof is omitted.

The correction of toner density is performed (1) when the image-forming apparatus is turned on, (2) when the ID cartridge 50 and/or the toner cartridge is replaced, and (3) when changes in environmental conditions such as temperature occur. The correction of toner density is also performed every predetermined number of printed pages, e.g., 100 pages, 300 pages, and 500 pages. Alternatively, the correction of toner density may be performed every 500th page after, for example, initial 1000 pages.

In order to detect the number of printed pages at which the graininess becomes poor, the drum count Dp is reset (1) when an unused, fresh toner cartridge is attached to the ID cartridge 50, (2) when the ID cartridge 50 is replaced, and (3) when the toner is replenished. Also, in order to determine the number of printed pages at which soiling of images appears, the drum count Dp is reset (1) when the apparatus is used for the first time and (2) when the ID cartridge 50 is replaced. The user resets the drum count Dp through the key operation from the operation panel 14. In the first embodiment, the same drum counter 16 is used to determine the number of printed pages at which the graininess occurs and the number of printed pages at which soiling of images occurs. Instead, separate counters may be employed. If the photoconductive drum 1 rotates, for example, 5 times for printing one page of print medium, then the drum count Dp is "10" for two pages.

The correction of toner density is performed according to the flowchart shown in FIG. 5, which will be described later in detail. When the correction of toner density is activated, a test pattern is formed on the photoconductive drum 1 or a transfer belt, not shown. The toner density sensor detects the density of the test pattern. Preliminary print conditions include, for example, the developing voltage DB that should be supplied to the developing roller 2, a charging voltage that should be supplied to the charging roller 4, and the amount of light emitted from the LED head 6. The preliminary print conditions for image formation are stored in the print-condition memory 19*a* in the controller 19, and are read from the print-condition memory 19*a* according to the detection output of the toner density sensor.

Each of the conditions for image formation has an upper limit and a lower limit, so that the image forming conditions are always within an appropriate range. For example, developing voltages DB lower than a certain limit (referred to as DB lower limit or DBL hereinafter) cause poor graininess. Graininess is the ability to reproduce dots when printing is performed for a 2×2 matrix. Conversely, developing voltages DB higher than a certain limit (referred to as DB upper limit or DBU hereinafter) cause soiling of images and "after-images".

Experiment revealed that replacing an ID cartridge or replenishing toner causes changes in the properties of toner, and the graininess becomes poor and tends to remain poor up to about initial 1000 pages but then to slowly improve for pages over the initial 1000 pages. This is mainly due to the fact that the ability of fresh, unused toner to acquire charge is poor and therefore the amount of charge per unit amount of toner is small. Insufficiently charged toner is difficult to adhere to the photoconductive drum 1, resulting in non-uniform deposition of toner on the surface of the photoconductive drum 1. Thus, the graininess can be improved by increasing the developing voltage DB, thereby increasing developing efficiency.

Experiment also shows that after printing 10,000 pages, the developing blade 7 and toner-supplying roller 3 start to wear so that the toner density increases to give rise to soiling of images. Decreasing the developing voltage DB to decrease the toner density will minimize soiling of images.

Figure 3:
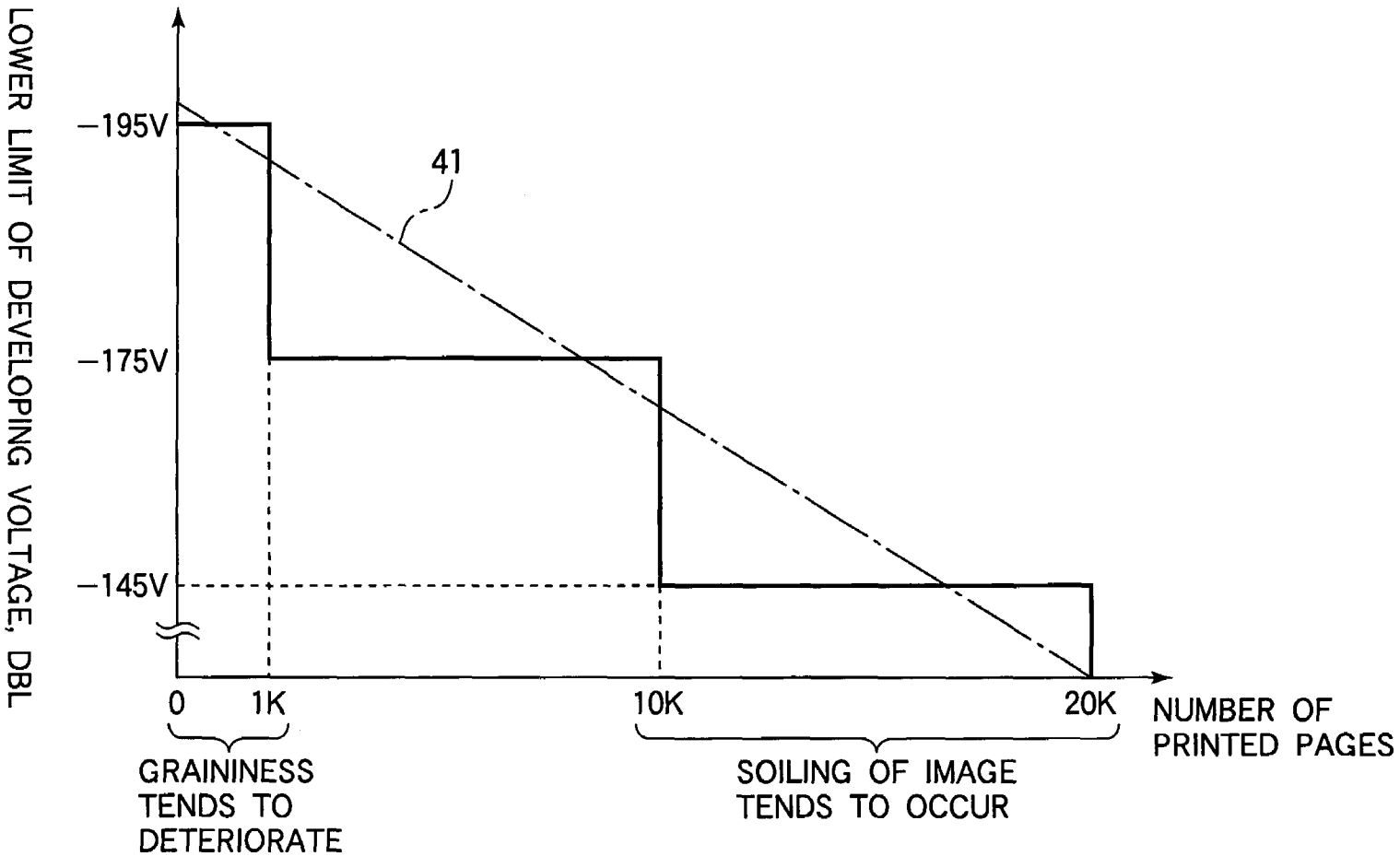
FIG. 3 illustrates how DBL of a developing voltage DB is changed as the number of printed pages increases.

FIG. 3 illustrates how the lower limit of the developing voltage DB is changed as the number of printed pages increases.

When the properties of toner in the ID cartridge 50 change due to replacement of the ID cartridge 50 and/or replenishment of toner, a somewhat high,DBL is maintained until additional pages, e.g., about 1000 pages, have been printed, thereby preventing the graininess from being deteriorated. Then, the DBL is changed stepwise to a lower value in accordance with the number of printed pages after 1000 pages. When about 10,000 pages have been printed after replacement of the ID cartridge 50 or when initial 10,000 or so pages have been printed since the apparatus was used for the first time, DBL is changed to a still lower value.

Figures 4, 5:
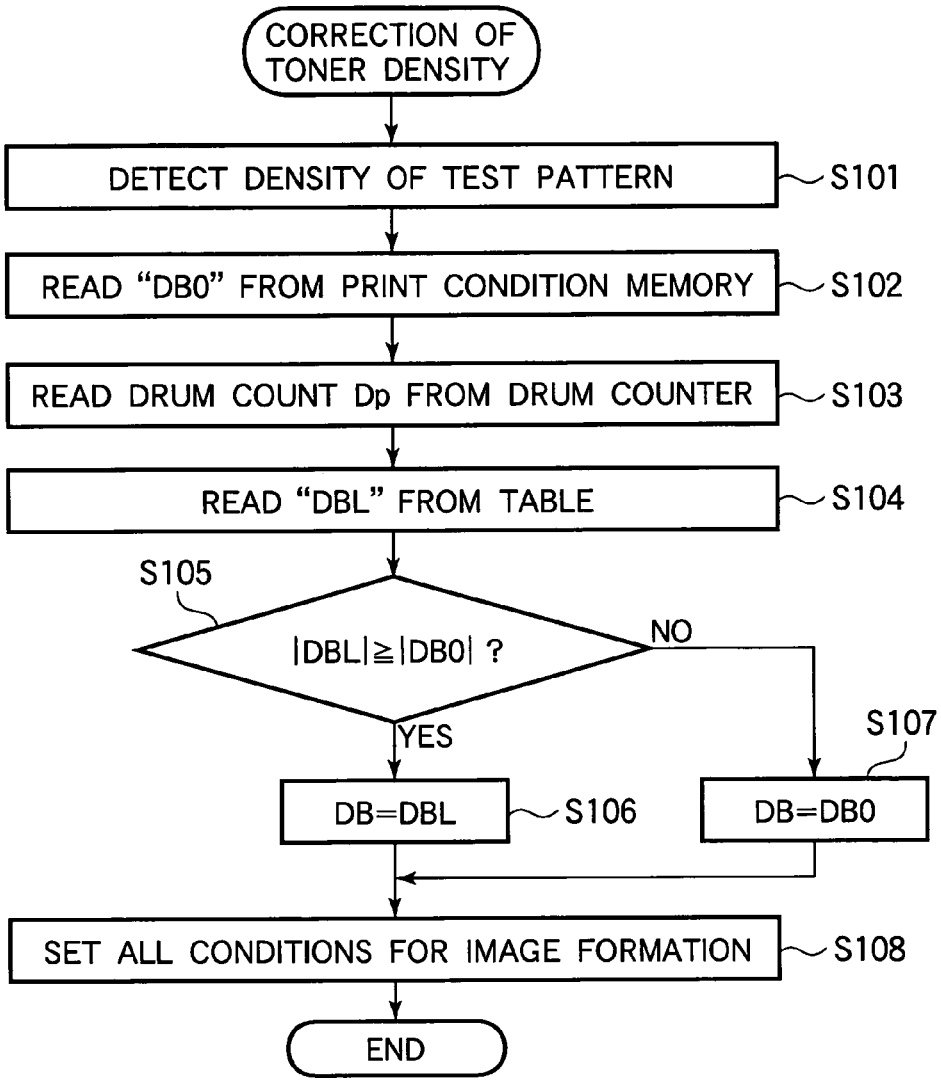
FIG. 4 illustrates TABLE 1 that lists values of DBL that correspond to the numbers of printed pages.
FIG. 5 is a flowchart illustrating the operation for setting DBL.

FIG. 4 illustrates TABLE 1 that lists values of DBL that correspond to the number of printed pages. TABLE 1 is stored in, for example, the ROM of the print controller 19.

{Operation for Setting DB Lower Limit}

FIG. 5 is a flowchart illustrating the operation for setting DBL.

The operation in which the DBL is changed as the number of printed pages increases will now be described in detail with reference to FIG. 5.

Referring to FIG. 5, at step S101, the toner density sensor detects the toner density of a test pattern. At step S102, a developing voltage DB0 corresponding to the toner density detected at step S101 is read from the print-condition memory 19*a* in the controller 19. At step S103, a drum count Dp is read from the drum counter 16. The relation between the number of rotations of the photoconductive drum 1 and the corresponding number of printed pages has been stored in advance.

At step S104, a value of DBL corresponding to the drum count Dp is read from TABLE 1. The values in TABLE 1 are determined based on the values lying on an experimentally determined reference line 41 in FIG. 3. The value of DBL is −195 V for pages in the range of 0 to 1000 pages, −175 V for pages in the range of 1000 to 10,000 pages, and −145 V for pages over 10,000 pages. Because these values of DBL may vary depending on the design of apparatus, the values of DBL are experimentally determined for individual models and types of image-forming apparatus.

Alternatively, the values of DBL may be determined so that the values of DBL are expressed in less or more than three levels. Still alternatively, the values of DBL may be set linearly along the reference line 41, though adding some complexity.

Then, at step S105, the absolute value of the developing voltage DB0 read from the print-condition memory 19*a* at step S102 is compared with that of DBL. If $|DBL| \geqq |DB0|$, then the program proceeds to step S106 where the ultimate value of developing voltage DB is set to DBL. If $|DBL| < |DB0|$, then the program proceeds to step S107 where the ultimate value of developing voltage DB is set to DB0. In this manner, |DB| can be set to a value equal to or greater than |DBL| at all times.

At step S108, all of the image forming conditions including the ultimate value of developing voltage DB and the amount of light emitted from the LED head 6 are finally set. This completes the correction of toner density. The time length during which the LEDs are energized is adjusted to control the amount of light to be emitted from the LED head 6. The longer the LEDs are energized, the more toner is deposited to the electrostatic latent image, so that the toner density increases.

In order to determine DBU, the degrees of after-images and soiling of images may be obtained experimentally as a function of the number of printed pages. Thus, just as in DBL, the values of DBU may be predetermined and appropriate values of DBU may be selected in accordance with the number of printed pages.

The values of DBU that corresponds to the number of printed pages may be stored in a table. The absolute value of the preliminary developing voltage DB0 is compared with that of DBU. If $|DB0| \geqq |DBU|$, then the ultimate value of developing voltage DB is set to DBU. If $|DB| < |DBU|$, then the ultimate value of developing voltage DB is set to DB0. In this manner, |DB| can be set to a value equal to or smaller than |DBU| at all times.

The correction of toner density is performed as described above. One of DBL and DBU or both of these can be set appropriately according to the number of printed pages since when the properties of toner in an ID cartridge have changed due to replacement of the ID cartridge and/or replenishment of toner. Correcting the toner density in this manner prevents graininess from deteriorating and soiling of images and/or after-images from occurring. The first embodiment has been mainly described with respect to a case in which correction is made to the developing voltage DB. The correction may also be made to the charging voltage that should be supplied to the charging roller 4 and the amount of light that should be emitted from the LED head 6.

Second Embodiment

A second embodiment incorporates a limit determining means that adjusts DBU and DBL according to the environmental temperature and humidity when the correction of toner density is performed.

{Construction}

The configuration of an image-forming apparatus and its control system according to the second embodiment is the same as those of the first embodiment, and therefore the description thereof is omitted. A temperature sensor and a humidity sensor are incorporated in the apparatus.

{Operation}

The operation of the image-forming apparatus according to the second embodiment will be described. Printing operation is performed in much the same way as a conventional electrophotographic image-forming apparatus and the description is omitted.

The correction of toner density according to the second embodiment is performed (1) when the apparatus is turned on, (2) when the ID cartridge 50 and/or toner cartridge is replaced, (3) when environmental conditions have changed, or (4) when the number of printed pages reaches predetermined values.

The correction of toner density according to the second embodiment will be described later in detail with reference to in a flowchart in FIG. 8. When the correction of toner density is activated, a test pattern is formed on the photoconductive drum 1 or a transfer belt, not shown. Then, the toner density sensor located close to the photoconductive drum 1 or the transfer belt detects the density of the test pattern. Preliminary print conditions for image formation are set in accordance with the detection output of the toner density sensor. The preliminary print conditions include, for example, the developing voltage DB that should be supplied to the developing roller 2, the charging voltage that should be supplied to the charging roller 4, and the amount of light to be emitted from the LED head 6. The preliminary print conditions for image formation are stored in the print-condition memory 19*a* and are read from the print-condition memory 19*a* according to the detection output of the toner density sensor.

In order to prevent soiling of images, after-images, and deterioration of graininess, the conditions for image formation have their upper limits and lower limits, i.e., DBI and DBL that vary depending on the number of printed pages.

Figure 6:
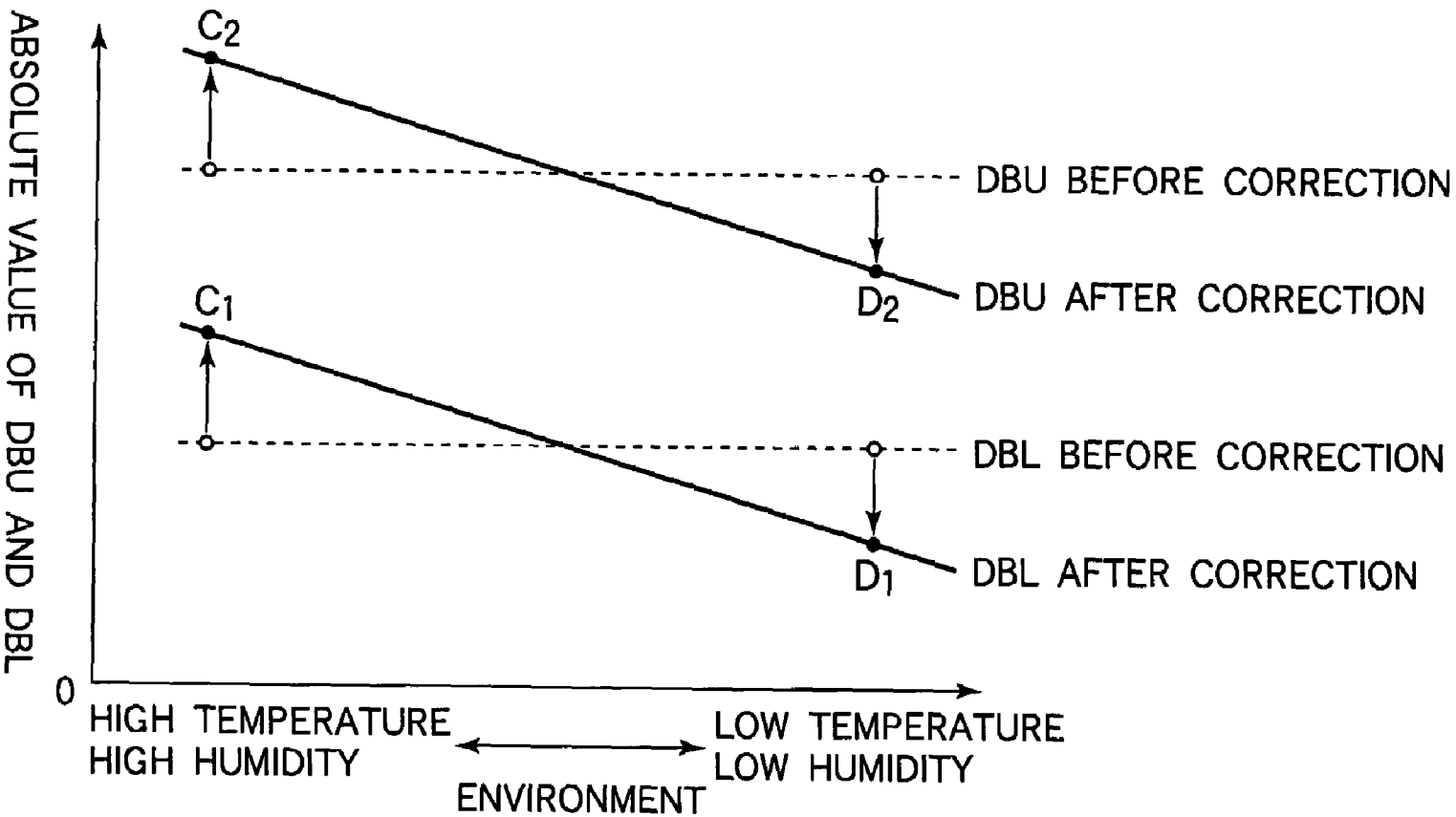
FIG. 6 illustrates DBU and DBL of the developing voltage DB according to a second embodiment.

FIG. 6 illustrates DBU and DBL of the developing voltage DB.

The toner density in a high-temperature and high-humidity environment decreases because the ability of toner to acquire charge decreases. Conversely, the toner density in a low-temperature and low-humidity environment increases because the ability of toner to acquire charge increases. Thus, the soiling of images tends to occur in a low-temperature and low-humidity environment. The temperature sensor and the humidity sensor detect the temperature and humidity in the apparatus, respectively, and DBU and DBL are varied according to the detected temperature and humidity. In other words, the absolute values of DBU and DBL are increased (depicted at C1 and C2 in FIG. 6) in a high-temperature and high-humidity environment and decreased (depicted at D1 and D2 in FIG. 6) in a low-temperature and low-humidity environment.

FIG. 7 shows TABLE 2 to TABLE 4 that illustrate environmental conditions in five levels.

In the second embodiment, an environment-dependent correction voltage Dh is used to correct DBU and DBL in accordance with changes in environmental conditions. For example, as shown in TABLE 2 in FIG. 7, temperature is divided at every 10 degrees into five ranges, and absolute humidity is divided at every 4 g/m$^3$ into five ranges in TABLE 3 in FIG. 7. The product of the temperature range and the humidity range is divided into five ranges, thereby defining "environment ranges" as shown in TABLE 4. The environment ranges are assigned corresponding environment-dependent correction voltages Dh.

As described previously, because the ability of toner to acquire charge increases in the low-temperature and low-humidity environment, DBU and DBL are lowered, thereby allowing the toner to acquire an appropriate amount of charge. By way of example, in a low-temperature and low-humidity environment in which, for example, the temperature is 10° C. and the humidity is 6 g/m$^3$, the temperature range is "1" and the humidity range is "2". Thus, environment range is "2" and a corresponding environment-dependent correction voltage Dh of +30 V is read from TABLE 4. In other words, +30 V is added to DBU and DBL, respectively, so that the absolute value of the developing voltage DB is decreased as depicted at D1 and D2 in FIG. 6.

Conversely, because the ability of toner to acquire charge decreases in the high-temperature and high-humidity environment, the DBU and DBL are corrected to higher values, thereby allowing the toner to acquire an appropriate amount of charge. By way of example, in a high-temperature and high-humidity environment in which, for example, the temperature is 35° C. and the humidity of 15 g/m$^3$, the temperature range is "4" and the humidity range is "4". Thus, the environment range is "16" and a corresponding environment-dependent correction voltage Dh of −15 V is read from TABLE 4. Then, the environment-dependent correction voltage Dh of −15 V is added to the DBU and DBL, respectively, so that the absolute value of DBU and DBL are increased as depicted at C and C' in FIG. 6.

{Operation for Setting DB Lower and Higher Limits}

Figure 8:
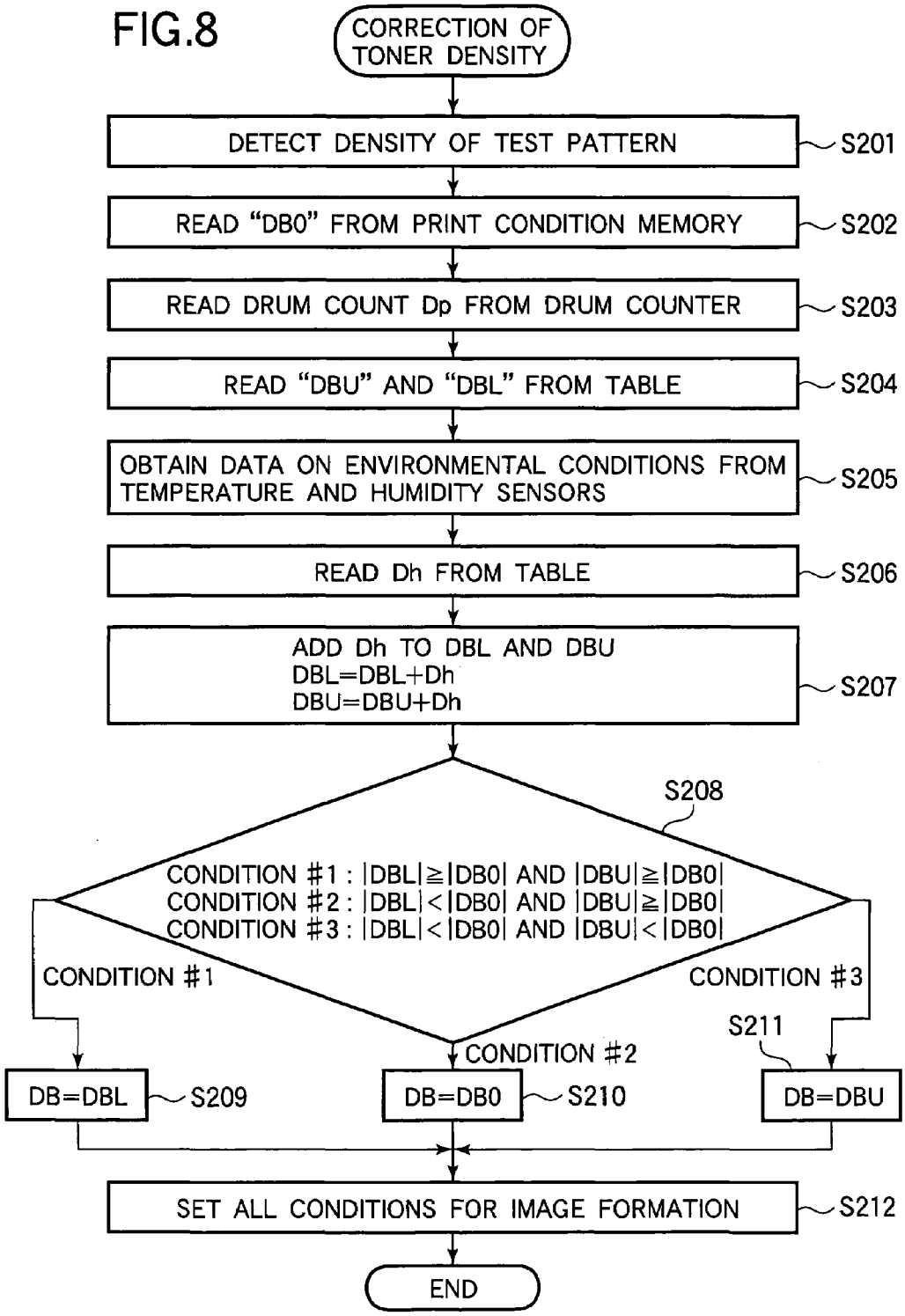
FIG. 8 is a flowchart illustrating the operation of the correction of toner density according to the second embodiment.

FIG. 8 is a flowchart illustrating the operation of the correction of toner density.

The operation of setting DBL and DBU in accordance with changes in environmental temperature and humidity will be described with reference to FIG. 8.

Referring to FIG. 8, at step S201, the toner density sensor detects the density of a test pattern. At step S202, a developing voltage DB corresponding to the density detected at step S201 is read from the print-condition memory 19*a*. At step S203, a drum count Dp which is a value corresponding to the number of rotations of the photoconductive drum 1 is read from the drum counter 16.

The ROM in, for example, the print controller 19 stores a table, not shown, that lists DBU and DBL and a corresponding number of printed pages. This table is similar to TABLE 1 in FIG. 4. At step S204, values of DBL and DBU (not shown) corresponding to the drum count Dp are read from the table.

At step S205, data on environmental conditions are determined based on the temperature and humidity detected by the temperature sensor and the humidity sensor. Then, at step S206, according to the data on environmental conditions, an environment-dependent correction voltage Dh for a corresponding environment is read from TABLE 4 (FIG. 7).

At step S207, the environment-dependent correction voltage Dh read at step S206 is added to DBL and DBU, respectively, thereby correcting DBU and DBL.

At steps S208–S211, the ultimate value of developing voltage DB is determined such that the developing voltage DB is between DBU and DBL that have been corrected at step S207. In other words, a decision is made to determine in which one of the three ranges the developing voltage DB falls. Thus, a decision is made at step S208 to determine whether the ultimate value of developing voltage DB satisfies CONDITION #1, CONDITION #2, or CONDITION #3. Then, the ultimate developing voltage DB is set at steps S210–S312 such that the ultimate developing voltage DB falls in a range defined by the above-corrected DBL and DBU, i.e., within the hatched area in FIG. 9.

Then, at step S212, all the conditions for forming images are established together with the amount of light to be emitted from the LED head 6. This completes the correction of toner density.

Instead of providing TABLE 4 that lists environment-dependent correction voltages Dh for correcting the developing voltage DB for changes both in temperature and in humidity, the environment-dependent correction voltage Dh may be provided either for temperature change or humidity change. Alternatively, instead of providing the environment-dependent correction voltages Dh that change stepwise, the environment-dependent correction voltages Dh maybe calculated, with some added complexity, as a variable expressed by a linear function of temperature and humidity. Still alternatively, the "environment range" may be less or more than five levels.

The aforementioned correction of toner density in FIG. 8 allows correction of DBU and DBL, thereby preventing the graininess from decreasing as well as preventing soiling of images and occurrence of after-images.

The second embodiment has been described with respect to a case in which every time the number of printed pages reaches predetermined values, the limit determining means modifies DBU and DBL according to the environmental temperature and humidity. Instead, DBU and DBL may be corrected in accordance with temperature and humidity regardless of the number of printed pages. The second embodiment has been mainly described with respect to a case in which correction is made to the developing voltage DB. The correction may also be made to the charging voltage that should be supplied to the charging roller 4 and the amount of light that should be emitted from the LED head 6.

Third Embodiment

{Construction}

An image-forming apparatus according to a third embodiment is a tandem type color image-forming apparatus and has a plurality of image forming sections each of which forms an image of a corresponding color. The apparatus has a limit determining section that selects different values of DBU and DBL for the individual image forming section. Thus, the values of DBU and DBL vary from image forming section to image forming section.

Figure 10:
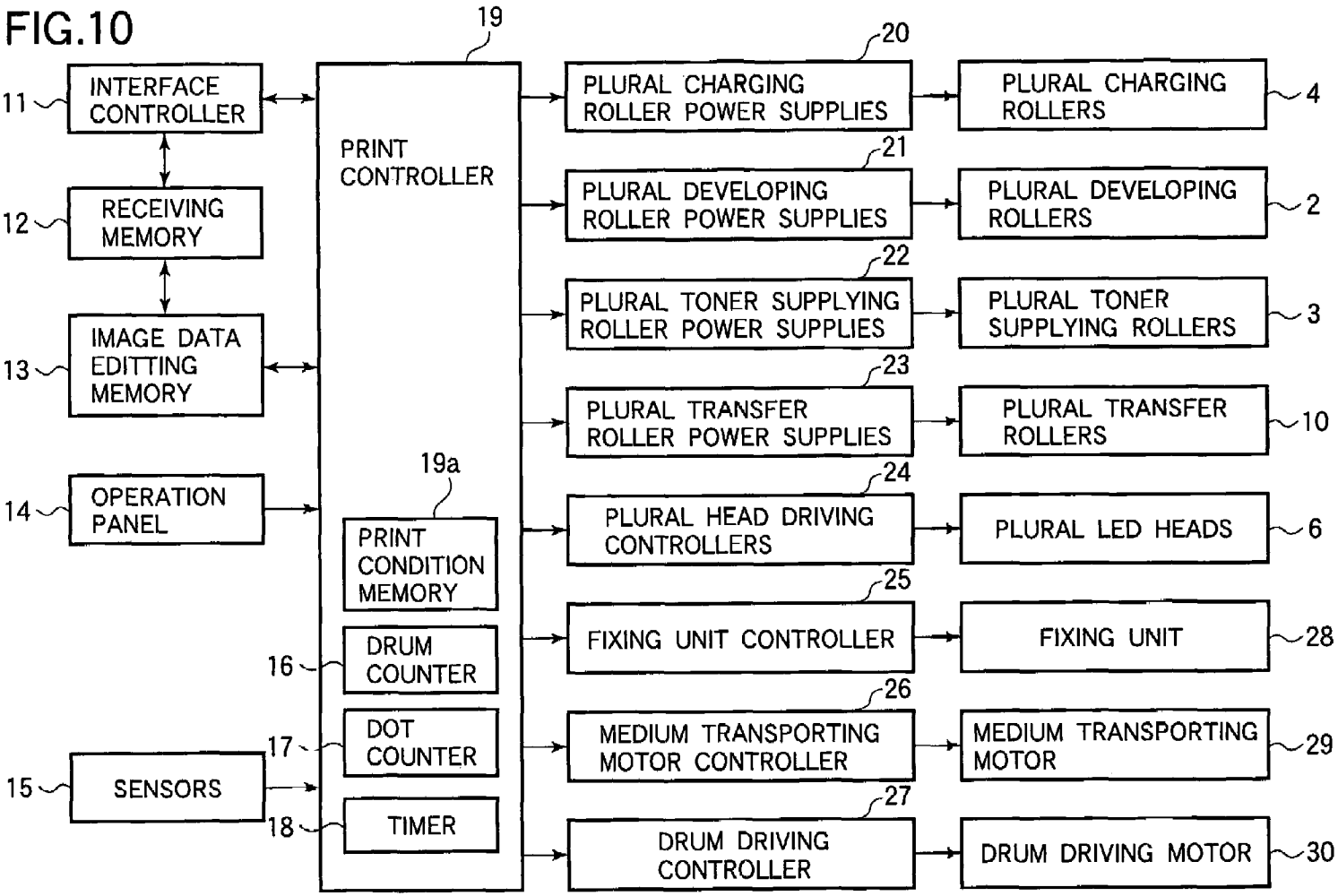
FIG. 10 is a control block diagram of a third embodiment.

FIG. 10 is a control block diagram of the third embodiment.

The configuration of an image-forming apparatus according to the third embodiment is the same as that of the first embodiment except that a plurality of image forming sections are provided, and therefore the detailed description is omitted. Each of the image forming sections includes a charging roller 4, a transfer roller 10, an LED head 6. For each of the image forming sections, the image-forming apparatus also includes a charging roller power supply 20, a developing roller power supply 21, toner-supplying roller power supply 22, a transfer roller power supply 23, and a head driving controller 24.

The image-forming apparatus according to the third embodiment performs printing in much the same way as the conventional apparatus incorporating a plurality of image forming sections, except for the correction of toner density. Therefore, the description of printing in the third embodiment is omitted.

{Correction of Toner Density}

The correction of toner density is performed (1) when the image-forming apparatus is turned on, (2) when an ID cartridge 50 and/or the toner cartridge is replaced, (3) when the environmental conditions change, (4) or when the number of printed pages reaches predetermined values. Preliminary print conditions include, for example, the developing voltage DB0 that should be supplied to the developing roller 2, the charging voltage that should be supplied to the charging roller 4, and the amount of light that should be emitted from the LED head 6. The preliminary print conditions are stored in a print-condition memory 19*a* in a print controller 19 and read from the print-condition memory 19*a* according to the detection output of the toner density sensor.

A commonly used color image-forming apparatus uses cyan, magenta, yellow, and black toners. The ability of these toners to acquire charge varies from color to color. For example, the colorant for black toner has a good ability to acquire charge and therefore black toner tends to cause soiling of images. The colorant for magenta toner has a low ability to acquire charge and therefore magenta toner tends to cause a blurred image. For these reasons, DBU and DBL are set to lower values for image forming sections that hold toners having a good ability to acquire charge. Conversely, DBU and DBL are set to higher values for image forming sections that hold toners having a low ability to acquire charge.

Figures 9, 11:
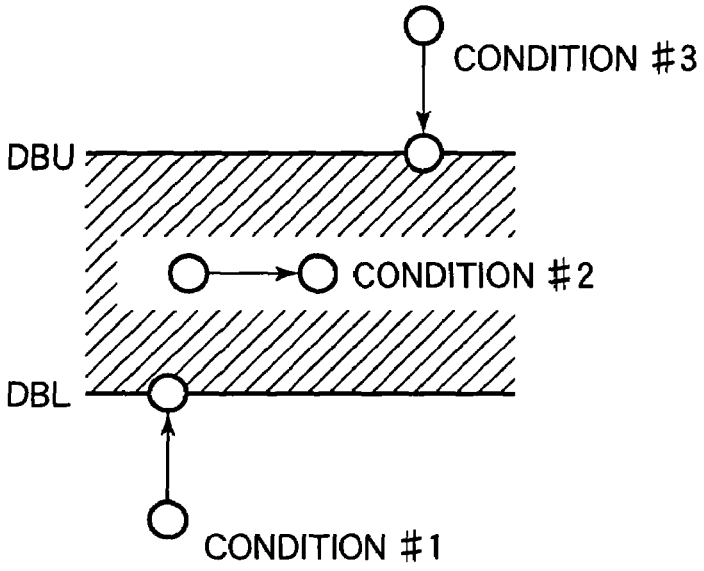
FIG. 9 illustrates how the limit values of DBL and DBU are determined.
FIG. 11 illustrates TABLE 5 that lists empirical color-dependent correction voltages Dh' for the respective colors.

FIG. 11 illustrates TABLE 5 that lists empirical color-dependent correction voltages Dh' for the respective colors.

The third embodiment also uses TABLEs 2–4 in FIG. 7

Figure 12:
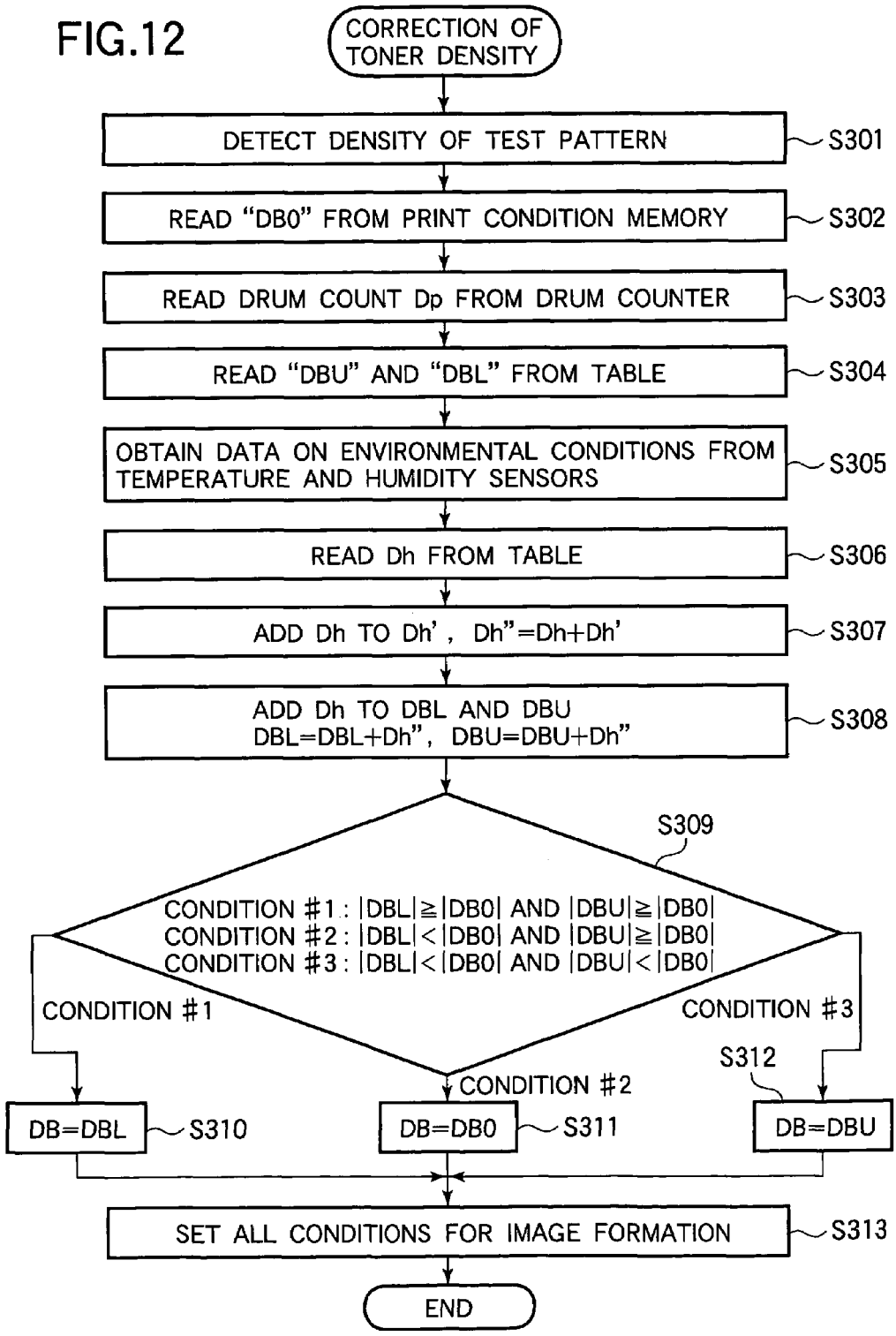
FIG. 12 is a flowchart illustrating the operation of the correction of toner density according to the third embodiment.

FIG. 12 is a flowchart illustrating the operation of the correction of toner density.

The correction of toner density according to the third embodiment will be described with reference to the flowchart in FIG. 12. The operation is substantially the same as the second embodiment except for the step S307 in which the correction voltage Dh" is calculated.

Referring to FIG. 12, at step S301, the toner density sensor detects the density of a test pattern. Then, at step S302, the developing voltage DB0 corresponding to the toner density detected at step S301 is read from the print-condition memory 19*a*. At step S303, a drum count Dp is read from the drum counter 16. At step S304, the DBL and DBU (not shown) that correspond to the drum count Dp are read from a table, not shown. At step S305, data on environmental conditions is obtained from the detection outputs of the temperature sensor and the humidity sensor. At step S306, the environment-dependent correction voltage Dh is read from TABLE 4 according to the data on environmental conditions obtained at step S305. Then, the color-dependent correction voltages Dh' for the respective image forming sections are read from TABLE 5 in FIG. 9.

Then, DBU and DBL for individual image forming sections are corrected as follows: At step S307, the values of Dh and Dh' are added together on an image forming section-by-image forming section basis, thereby producing a new correction voltage Dh". At step S308, the new correction voltage Dh" is added to DBL and DBU, respectively.

From TABLE 4, for example, when the temperature is 35° C. and the humidity is 15 g/m$^3$, the humidity range is "4" and therefore the environment range is "16" so that the new correction voltage Dh is −15 V. From TABLE 5, Dh' for the magenta ID cartridge is −30 V and therefore the new correction voltage Dh" is given by Dh+Dh'=Dh", i.e., (−15)+(−30)=−45 V. The thus obtained Dh" is added to the DBL and DBU, respectively. In other words, the resulting DBL and DBU are negative and have larger absolute values.

Just as in the second embodiment, at step S309, a decision is made to determine whether the developing voltage DB0 read from the print-condition memory 19*a* at step S302 satisfies CONDITION #1, CONDITION #2, or CONDITION #3. Then, the ultimate developing voltage DB is set at steps S310–S312 such that the ultimate developing voltage DB falls in a range defined by the above-corrected DBL and DBU. At step S313, all the conditions for image formation including the developing voltage DB and the amount of light to be emitted from the LED head 6 are finally set. This completes the correction of toner density.

For highly precise correction of toner density with respect to the environment, each of the image forming sections may have exclusive temperature and humidity sensors. According to the data on the environment obtained from the respective temperature and humidity sensors, values of Dh and Dh' for each image forming section are read from TABLE 4 and TABLE 5, respectively. Then, the values of Dh and Dh' are added to the DBL and DBU, respectively, thereby correcting the DBL and DBU in terms of color and environmental condition.

As described above, the environment-dependent correction is first performed using the data on environmental conditions obtained through the temperature sensor and humidity sensor, and then the DBL and DBU are corrected on an image forming section-by-image forming section basis. Alternatively, the environment-dependent correction may be omitted so that only DBL and DBU are corrected on an image forming section-by-image forming section basis.

The third embodiment has been described with respect to a case in which the DBL and DBU are corrected when the number of printed pages reaches predetermined values. Alternatively, the correction of toner density with respect to the number of printed pages may be omitted so that only DBL and DBU are corrected on an image forming section-by-image forming section basis.

Correcting the DBL and DBU on an image forming section-by-image forming section basis prevents the graininess from deteriorating and prevents soiling of images and after-images from occurring. The third embodiment has been mainly described with respect to a case in which correction is made to the developing voltage DB. The correction may also be made to the charging voltage that should be supplied to the charging roller 4 and the amount of light that should be emitted from the LED head 6.

{Modification}

Modifications may be made as follows:

(1) Instead of changing DBL and DBU based on the number of printed pages, DBL and DBU may be changed in accordance with the amount of toner consumed. For example, the dot counter 17 counts the total number of dots to be printed on each page and DBL and DBU may be changed in accordance with the accumulated count of dots. Alternatively, the dot counter 17 counts a total cumulative number of printed dots on a color-by-color basis, DBL and DBU for each color are corrected based-on the accumulated count of dots.

(2) The embodiments have been described with respect to an image-forming apparatus in which a DBL and DBU table, an environment-dependent correction table, and a color-dependent correction table are stored in the ROM of the print controller 19. If a system is configured in such a way that a plurality of image-forming apparatus are controlled through a network by a central controller, the central controller may be configured to determine DBL and DBU for each of the plurality of image-forming apparatus. In such a case, providing a table of DBL and DBU for each type of image-forming apparatus allows setting of even more appropriate values of DBL and DBU.

(3) The embodiments have been described with respect to a case in which DBU and DBL are simultaneously changed. Alternatively, only DBU or DBL may be changed depending on the configuration of the image-forming apparatus.

(4) The embodiments have been described with respect to a case in which both DBU and DBL are changed. The present invention may be applied to an apparatus in which DBU and DBL are provided for the following variables: the voltage applied to the toner-supplying roller 3, the voltage applied to the photoconductive drum 1, and the amount of light to be emitted from the LED head 6. The present invention may be applicable to these variables separately or in combination with the developing voltage.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image-forming apparatus, comprising:

an image forming section having an image bearing body that bears an electrostatic latent image;

a status detecting section that detects at least one of an operation status in which said image forming section operates and an environmental condition on which said image forming section operates;

a print condition setting section that sets a preliminary print condition for said image forming section;

a limit setting section that sets a limit value in accordance with the at least one of the operation status and the environmental condition;

a print controller that compares the preliminary print condition with the limit value to determine an ultimate print condition for said image forming section based on a comparison result.

2. The image-forming apparatus according to claim 1, wherein said image forming section includes a developing unit that supplies toner to the electrostatic latent image formed on the image bearing body to form a toner image.

3. The image-forming apparatus according to claim 2, wherein the ultimate print condition is a voltage that should be supplied to the developing unit.

4. The image-forming apparatus according to claim 2, wherein the preliminary print condition is a voltage that should be supplied to the developing unit.

5. The image-forming apparatus according to claim 4, further comprising a toner density detecting section, wherein said print controller controls the toner density detecting section to detect a toner density of the toner image and then said print condition setting section sets, based on the toner density, the voltage that should be supplied to the developing unit.

6. The image-forming apparatus according to claim 1, wherein the operation status is a number of printed pages, wherein said limit setting section sets the limit value based on the number of printed pages.

7. The image-forming apparatus according to claim 6, wherein the preliminary print condition is a voltage that should be supplied to the developing unit, the limit value being a lower limit value of the voltage and increasing in absolute value with decreasing number of printed pages.

8. The image-forming apparatus according to claim 7, wherein the limit value is changed stepwise.

9. The image-forming apparatus according to claim 7, wherein the limit value is varied continuously.

10. The image-forming apparatus according to claim 8, further comprising a temperature detecting section that detects a temperature at which said image forming section operates and a humidity detecting section that detects a humidity at which said image forming section operates, wherein said limit setting section determines the limit value based on the temperature and the humidity.

11. The image-forming apparatus according to claim 10, wherein the operation status is a number of printed pages, wherein said limit setting section determines the limit value based on the number of printed pages and then determines the limit value based on the temperature and humidity.

12. The image-forming apparatus according to claim 11, wherein the limit value is determined such that the limit value has a larger absolute value in a high-temperature and high-humidity environment than in a low-temperature and a low-humidity environment.

13. The image-forming apparatus according to claim 6, wherein the preliminary print condition is a voltage that should be supplied to the developing unit, the limit value being an upper limit value of the voltage.

14. The image-forming apparatus according to claim 1, further comprising a temperature detecting section that detects a temperature at which said image forming section operates, wherein said limit setting section determines the limit value based on the temperature.

15. The image-forming apparatus according to claim 1, further comprising a humidity detecting section that detects a humidity at which said image forming section operates, wherein said limit setting section determines the limit value based on the humidity.

16. The image-forming apparatus according to claim 1, wherein said image forming section is one of a plurality of image forming sections, and said limit setting section sets limit values so that the plurality of image forming sections operate on different ultimate print conditions.

17. The image-forming apparatus according to claim 16, wherein the plurality of image forming sections include a yellow image forming section, a magenta image forming section, a cyan image forming section and a black image forming section.

18. The image-forming apparatus according to claim 1, wherein the operation status is an amount of toner consumed, wherein said limit setting section determines the limit value based on the amount of toner consumed.

19. The image-forming apparatus according to claim 1, wherein said image forming section includes a charging unit that charges a surface of the image bearing body, and the ultimate print condition is a voltage that should be applied to the charging unit.

20. The image-forming apparatus according to claim 1, wherein said image forming section includes an exposing unit that illuminates a surface of the image bearing body to form an electrostatic latent image, and the ultimate print condition is an output of the exposing unit.

* * * * *